US007108057B2

(12) United States Patent
Baird

(10) Patent No.: US 7,108,057 B2
(45) **Date of Patent: *Sep. 19, 2006**

(54) APPARATUS FOR CONTROLLING THE ASCENT AND DESCENT OF PIPE IN A WELL BORE

(75) Inventor: Jeffery D. Baird, Ada, OK (US)

(73) Assignee: Shamrock Research & Development, Inc., Breckenridge, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/333,696

(22) Filed: Jan. 17, 2006

(65) Prior Publication Data

US 2006/0113074 A1 Jun. 1, 2006

Related U.S. Application Data

(63) Continuation of application No. 10/673,952, filed on Sep. 29, 2003, now Pat. No. 6,997,251.

(51) Int. Cl.
*E21B 15/00* (2006.01)

(52) U.S. Cl. ..... 166/77.51; 294/82.16

(58) Field of Classification Search ..... 166/77.51, 166/77.53, 83.1; 175/423; 294/82.16
See application file for complete search history.

(56) References Cited

U.S. PATENT DOCUMENTS 1,028,759 A 6/1912 McKee
1,503,523 A 8/1924 Thomas et al.
1,586,968 A 6/1926 Crickmer
1,860,062 A 5/1932 Taylor
1,933,172 A 10/1933 Humason
2,575,356 A 11/1951 Mullinix
2,810,552 A 10/1957 Martin
3,122,811 A 3/1964 Gilreath
3,472,535 A 10/1969 Kinley
3,579,753 A 5/1971 Pryor
3,779,347 A 12/1973 Chevalier
4,200,054 A 4/1980 Elliston
4,324,194 A 4/1982 Elliston
6,471,439 B1 10/2002 Allamon et al.
6,997,251 B1 * 2/2006 Baird ..... 166/77.51

* cited by examiner

*Primary Examiner*—William Neuder
(74) *Attorney, Agent, or Firm*—Jackson Walker, LLP

(57) ABSTRACT

A method for controlling the ascent and descent of a tubular member passing through a pipe or casing slip into a well bore. A float control member is affixed beneath the top surface of the pipe or casing slip. The control member is activated to control the raising or lowering of the tubular member. A piston within a cylinder housing is positioned below the top surface of the slip. As the tubular member is lowered, but before there is significant weight on the supporting structure, the piston is moved to its maximum height extension. Once the slips are set and the weight of the tubular member is applied to the slips, the piston begins to descend in the cylinder housing floating the final descent of the string. The string may be raised by activating a pump to force fluid within the housing chamber, raising the piston and thereby raising or lifting the string.

5 Claims, 6 Drawing Sheets

APPARATUS FOR CONTROLLING THE ASCENT AND DESCENT OF PIPE IN A WELL BORE

This is a continuation application of U.S. patent application Ser. No. 10/673,952 now U.S. Pat. No. 6,997,251, filed Sep. 29, 2003.

BACKGROUND OF THE INVENTION

The present invention relates to well drilling technology. More particularly, the present invention relates to a method and apparatus for controlling the ascent and descent of vertical pipe or other tubular members passing through a pipe or casing slip into a well borehole.

It is well known in the oil well drilling art that pipe or casing slip assemblies are utilized in oil field operations for drilling, setting casing, or placing or removing any tubular member from a well bore. An excellent explanation of the function and operation of drill pipe slip assemblies is provided in U.S. Pat. No. 6,471,439, which is incorporated herein by reference for all purposes.

One of the most significant problems encountered in setting slips is maintaining control of the descent of the pipe into the slip and the slip into the slip bowl. The extensive lengths of piping in a drill string may result in considerable weight having to be controlled by the rig operator's braking procedures. Dropping the weight too quickly may result in damage to the pipe wall leading to fatigue of the pipe or breaking of the slip dies. If a pipe section fails the entire length of the drill string below the failure may be lost. Attempts to pull stuck drill strings from the well bore often puts site personnel at considerable safety risk. The draw works (block and tackle arrangement) may snap or the derrick rigging itself may collapse. These problems are associated with the pulling or supporting of the drill string from above the rig platform and, more particularly, having the pulling or supporting force coming from above the top surface of the slip. Casing jacks have been used in the past to pull old casing from the well bore. However, these are set up after the well is drilled. With the present invention the float system may be in place before the drilling starts.

The present invention provides a number of embodiments which push or support the drill string from beneath rather than pulling from above. The same method and apparatus allows for the string to be cushioned, controlled, or dampened in its descent thereby reducing pipe or casing wall failures. Thus, the present invention further reduces the likelihood of broken slip teeth (dies) and crimping and fatiguing of the pipe wall which results in pipe failure.

DETAILED DESCRIPTION OF THE PREFERRED EMBODIMENT

Figure 1A:
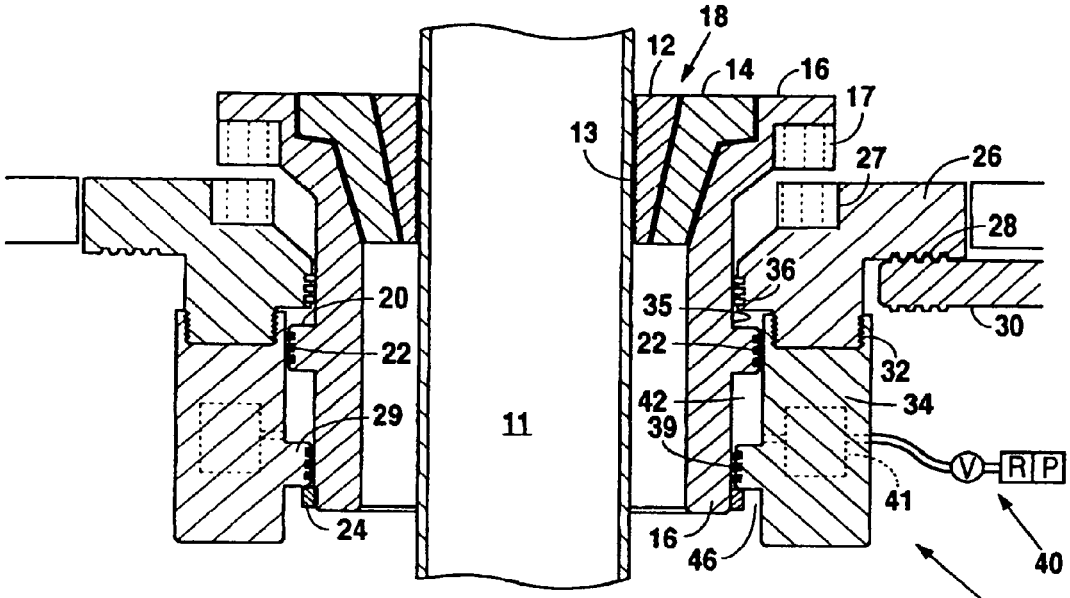
FIG. 1A is a side elevation, cross-sectional view of the pipe floating system of the present invention in a first unloaded position. The lifting member is disposed within the slip bowl.
Figure 1B:
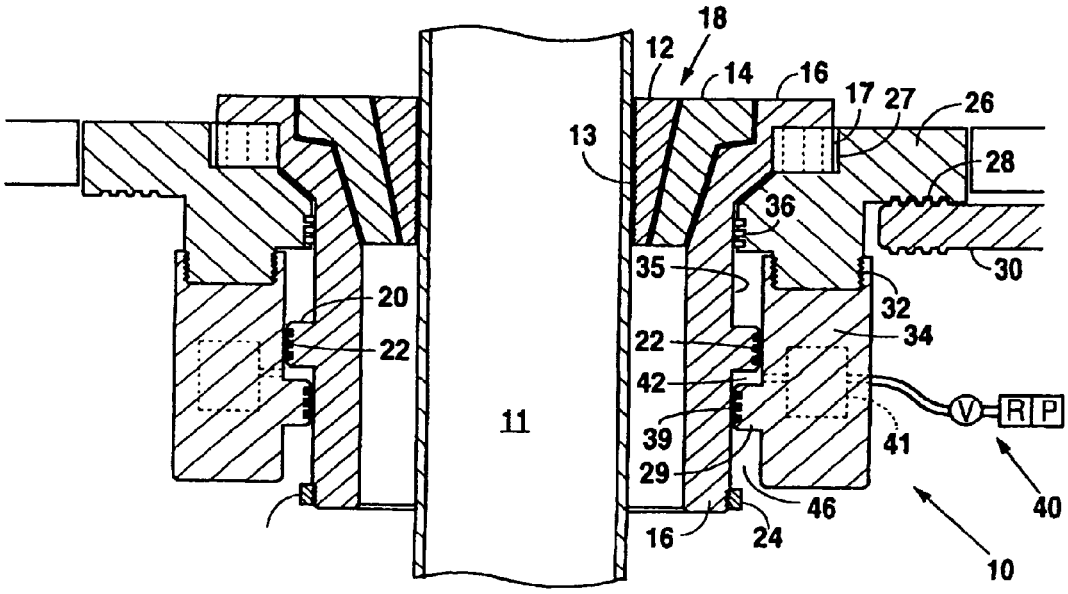
FIG. 1B is the system of FIG. 1A in a second loaded position.

FIGS. 1A and 1B illustrate a side elevation, cross-sectional view of a pipe floating system 10 of the present invention. FIG. 1A shows the system in a first unloaded position.

FIG. 1B illustrates a second loaded position. A section of drill string pipe 11 passes through a pipe or casing slip 12 into a well borehole. The construction of the conventional slip 12 is well known in the art. The slip teeth 13 engage the outer surface of the pipe or casing and are rotatably held within slip bowl bushings 14. The ascent and descent of the pipe 11 may be controlled by the raising and lowering of the primary piston bowl assembly 16 into which the slips 12 and bushing 14 fit. It should be understood that the intent of the present invention system is to control the ascent and descent from beneath the top surface 18 of the slips.

The piston bowl assembly 16 is provided with a circumferential piston head 20, seals 22, and a retainer ring 24. An upper rotary table insert 26 supports the piston bowl assembly and may optimally be driven by a gear 28 and pinion 30 drive mechanism Pinion 30 engages gear 28 in upper table insert 26. Rotation of the pinion is translated into rotary motion of the insert and the piston bowl assembly 16 via meshing of splines 27 in the insert with complementary splines 17 in the bowl assembly.

The upper insert 26 is attached at joint 32 to the lower table insert 34. Seals 36 along the inner face of upper table insert 26 seal against the sliding face 35 of piston bowl assembly 16 as will be further understood below. Lower table insert 34 is provided with a cooperating circumferential piston shoulder 29 having seals 39. Thus, a fluid chamber 42 is formed between the underside of the piston head 20 and the upper side of piston shoulder 29. The chamber 42 is sealed by seal sets 22 and 39. Oil is provided to chamber 42 by an oil pressure control system 40. A pressure control valve V allows oil to flow between chamber 42 and reservoir R.

FIG. 1A illustrates the pipe float system 10 in a first unloaded position. Pipe 11 is suspended by overhead rigging not shown but well known in the art. The slips have been inserted into the slip bushings within the piston bowl. The chamber 42 is at its full volume and filled with oil (and an inert gas to provide cushioning as desired). As the weight of the drill string is allowed to bear upon the slips, the pipe's descent is controlled by the "cushion effect" or the "dampening effect" of the oil in the chamber. The pressure control system 40 allows oil to bleed past the control valve V and into the oil reservoir R.

When the full weight of the drill string is loaded onto the pipe float system 10, the piston bowl assembly 16 has moved to a second loaded position as shown in FIG. 1B. It should be understood that an oil reservoir 41 may be incorporated into the lower table insert 34 as shown in broken lines in FIG. 1B. Further, it is envisioned within the scope of the present inventive system that the oil pressure control system may be provided with pumps, valves, automated weight control system and piping capable of injecting oil into the chamber 42 as necessary to assist in the lifting of the slips, slip bushings, and the piston bowl assembly. Thus, with the present system both the descent and ascent of the drill string may be controlled from beneath the top surface of the slips.

To ensure that the bowl assembly is not overly extended either in the load or unload position, retainer ring 24 is threadingly secured to the bottom of piston assembly bowl 16.

Figure 2A:
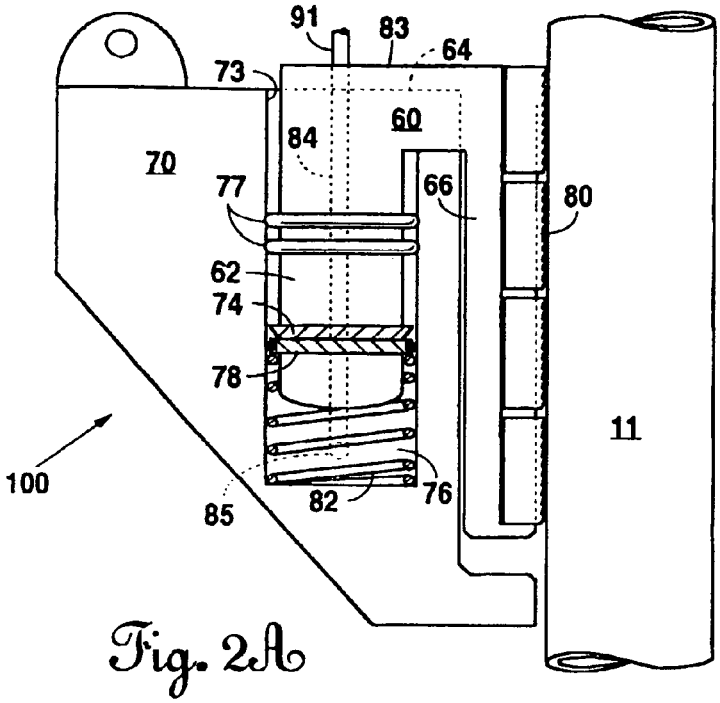
FIG. 2A is a side elevation, cross-sectional view of an alternative embodiment of the pipe floating system of the present invention in a first unloaded position. The lifting member is disposed within the slip itself.
Figure 2B:
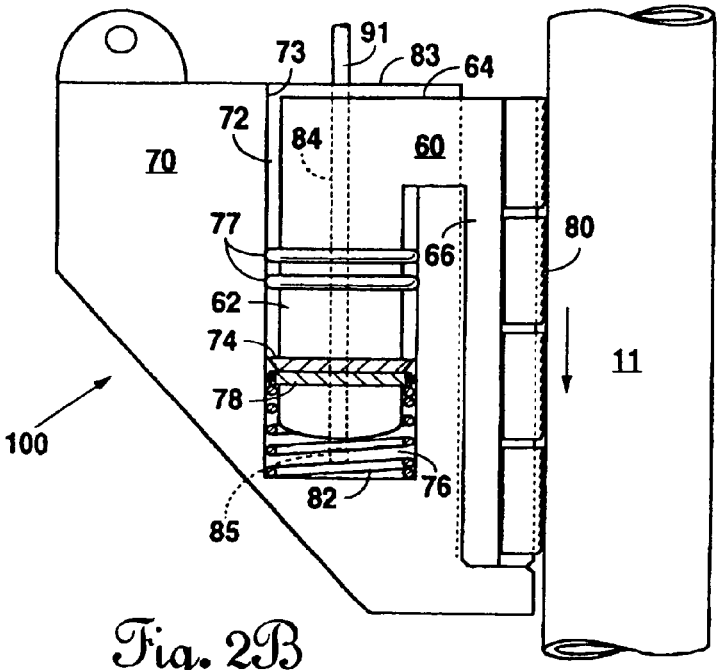
FIG. 2B is the embodiment of FIG. 2A in a second loaded position.
Figure 5:
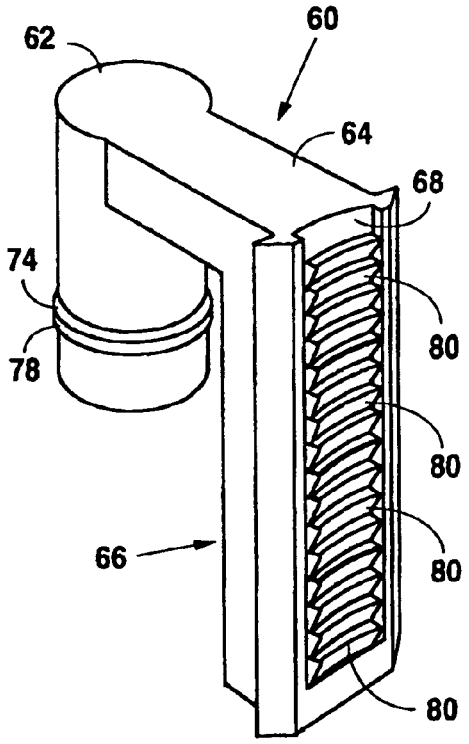
FIG. 5 illustrates a perspective view of the piston of the floating pipe system with replaceable slip teeth inserted.

Turning to FIGS. 2A and 2B, an alternative embodiment of the present invention is illustrated. In this embodiment the system 100 employs an ascent and descent control mechanism within the slip wedge itself. An L-shaped piston member 60 slides within a cylinder housing 72 within each wedge segment 70. The piston 60 has a cylindrical head section 62, a horizontal extension 64 and a vertical leg 66 (FIG. 5). The leg has a notch 68 which accepts replaceable slip teeth segments 80. Each piston 60 has various sets of ring seals. O-rings 77 are attached to the outer surface of the piston to seal against the cylinder wall 73. A bypass ring 74 may be attached to the piston to further control the oil flow within the pressure chamber 76 as will be described below. A sealing ring 78 is affixed to the piston to seal oil within and to retain a compression spring 82 in the chamber 76.

Figure 3:
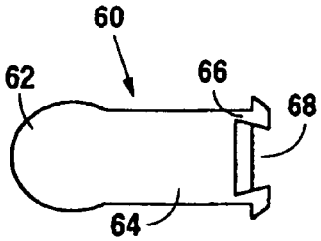
FIG. 3 is a top view of the piston member of the embodiment of FIG. 2.

FIG. 3 illustrates a top plan view of the piston 6 showing the head section 62, the extension 64, the leg 66, and the slip teeth receiving notch 68.

Figure 4:
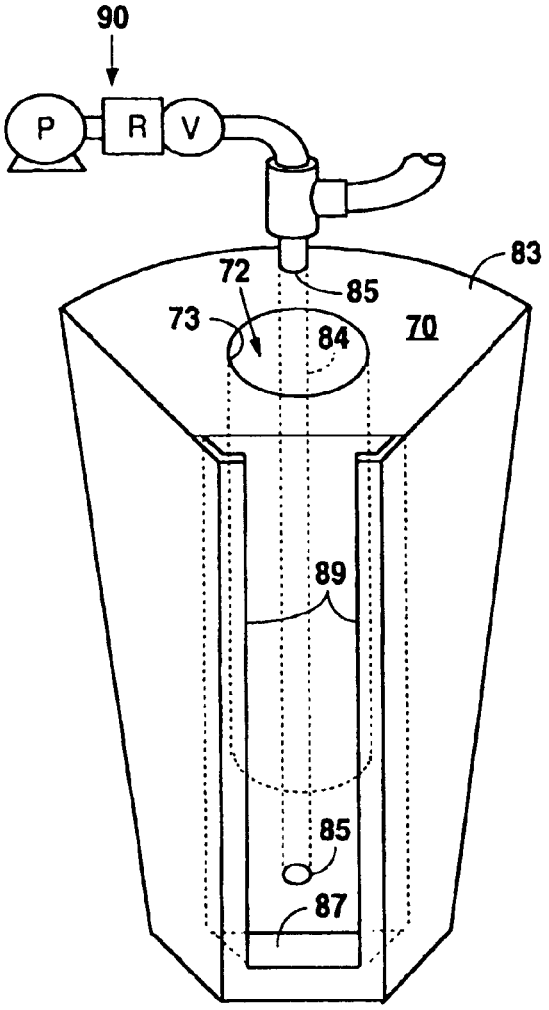
FIG. 4 shows a perspective view of the slip wedge of the embodiment of FIG. 2 with the associated hydraulics.

The wedge segment 70 has a piston cylinder housing 72 for retaining the piston head section 62, a hydraulic pressure vein 84 extending from the top surface 83 of the segment and exiting at a location 85 near the bottom of the cylinder housing below the piston head. As will be described further, oil in the chamber 76 may flow through vein 84 when the piston head 60 moves within the housing 72 to raise and lower the slip segments 80. A piston leg guide 89 (FIG. 4) extends along one edge of the segment 70 to guide and retain the piston leg with the slip teeth sections. A slip seat 87 is disposed at the bottom of guide 89 to prevent the leg 66 and slip segments 80 from excessive downward travel. FIG. 4 shows a wedge segment and an associated pressure control system 90. System 90 has an oil reservoir R, a pressure control valve V, piping 91, and pump P as needed.

FIG. 2A depicts the piston 60 in a first unloaded position. Only one slip segment is illustrated for clarity. The slip segments 80 and the leg 66 are holding pipe 11 as it is being lowered. The weight of the pipe string is transferred to the piston head 62 as the slip teeth engage the pipe. The head 62 compresses the oil in chamber 76 and this increased fluid pressure is translated to the pressure control system 90. Thus, the downward movement of the drill string is cushioned or dampened by the system 100.

To provide further controls of the movement (upward and downward) of the pipe, a flow pressure ring 74 having a beveled edge or drilled through holes may be affixed to the piston head 62. Further control may be provided by a compression spring 82 retained in the chamber 76 within the housing 72 beneath a piston ring 78. Any number of further controls may be provided.

FIG. 2B shows the piston 60 in a second loaded position having taken the weight of the drill string and stopping at seat 87. Again, it is within the scope of the present invention that the oil pressure control system may inject oil into the chamber 76 as necessary to assist in the ascent or lifting of the slips and the drill string. While the present discussion has disclosed the use of an oil pressure system, it is within the scope of the invention that any pressure regulation system such as springs, inert gas, or other hydraulic fluids may be used.

Figure 6:
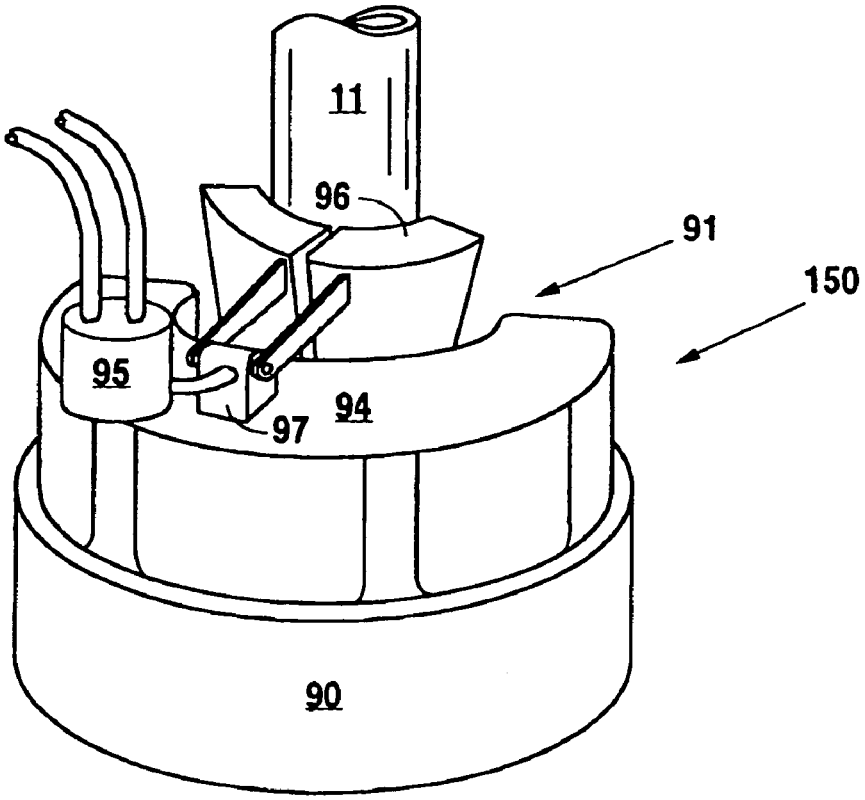
FIG. 6 shows a slip spider mechanism on a lifting platform of the present invention.
Figure 7:
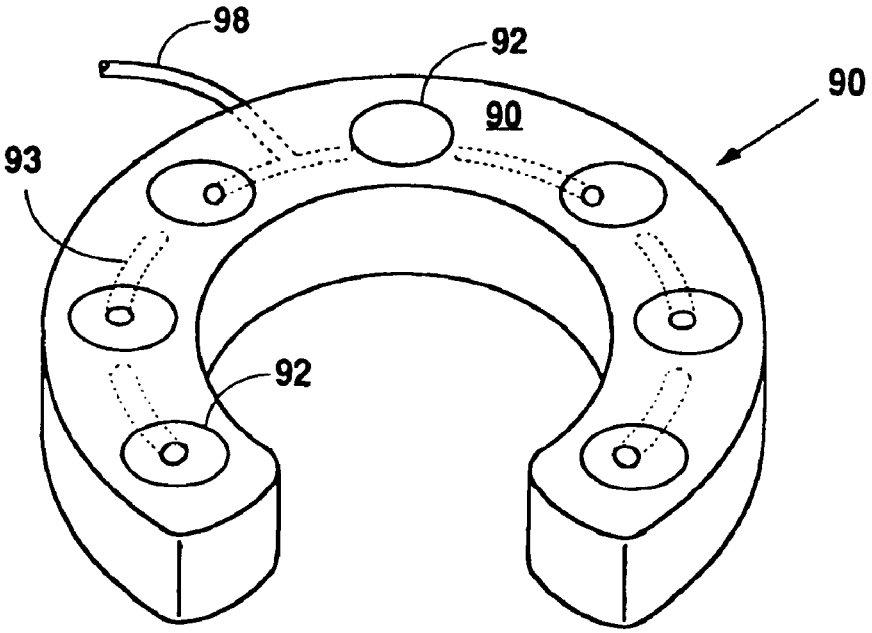
FIG. 7 illustrates the floating platform of the FIG. 6 embodiment showing the hydraulic cylinders.
Figure 6A:
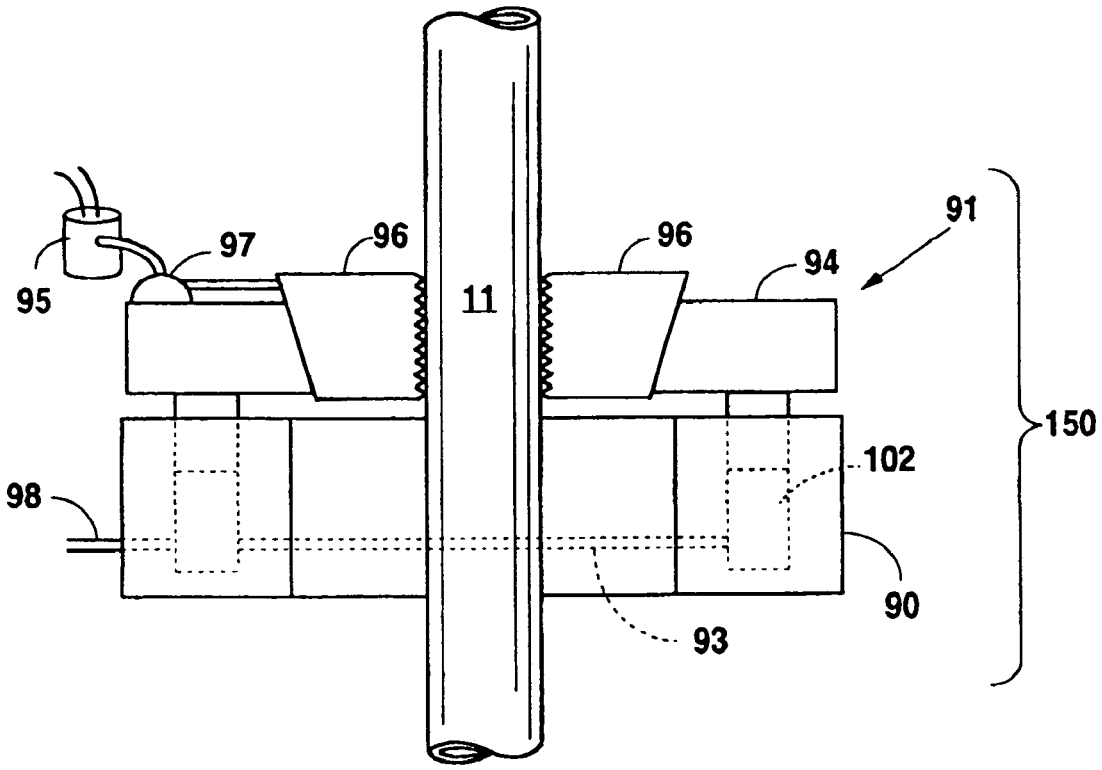
FIG. 6A is a side elevation, cross-sectional view of the embodiment of FIG. 6.

FIGS. 6, 6A, and 7 illustrate yet another embodiment 150 of the present invention. A spider system 91 for setting slips on production tubing and casing is well known in oil field art. A hydraulic or electric motor 95 activates an extension and retraction unit 97 which controls the clamping action of the slip wedges 96 about the pipe 11. In the present inventive embodiment, an ascent/descent control platform 90 supports the spider system 91 on the well head.

FIG. 7 shows a simple U-shaped platform base 97 adapted to accommodate a plurality of lifting jacks 102 within housings 92. The jacks 102 are connected by common control conduit 93 linking the jacks so that they may be raised and lowered at the same time. From the foregoing description of the other embodiments it should be understood that the final descent of the tubing or casing string may be controlled by controlling the upward and downward movement of the jack 102. A suitable pressure control system is connected to the control conduit through piping 98 extending from the control conduit to the pressure regulation system.

Figure 8:
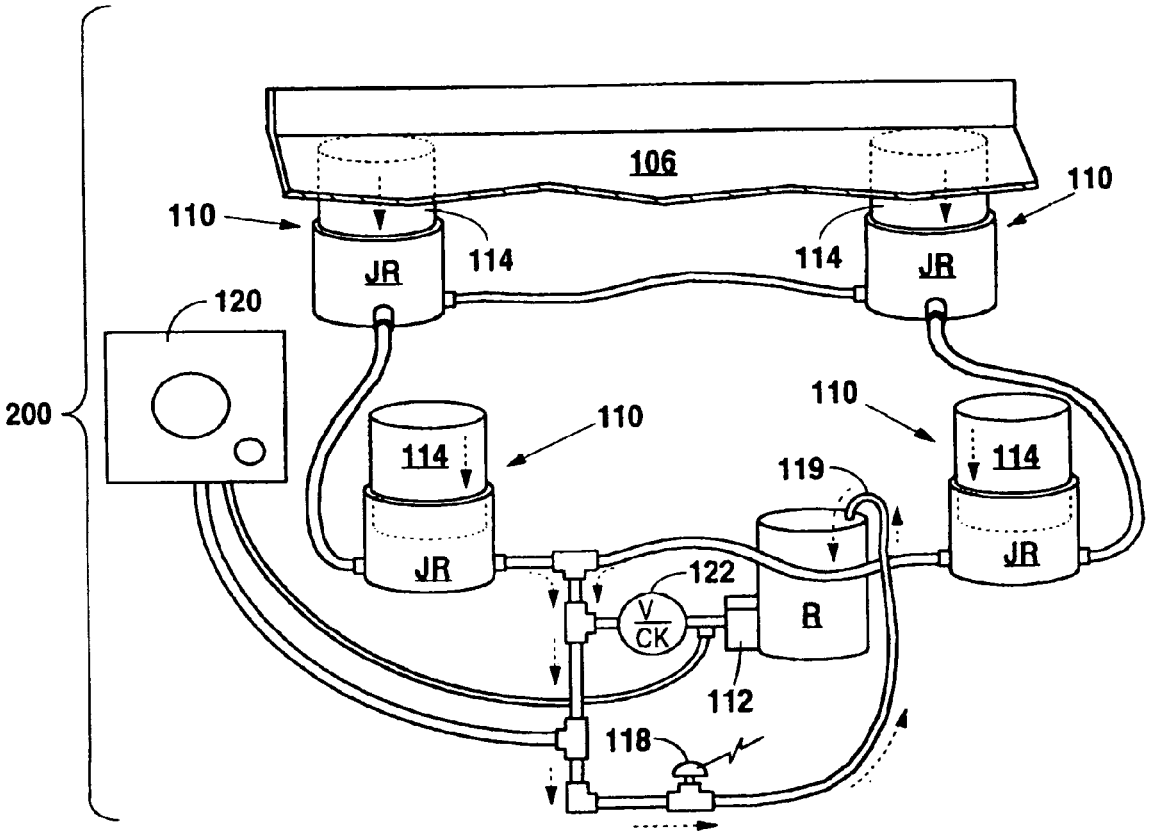
FIG. 8 is a perspective view of yet another embodiment of the present invention in a rotary table floating frame.

Another embodiment of the present invention is illustrated in FIG. 8. In system 200, a rotary table (not shown), well known in the art, is supported by a frame 106. Beneath frame 106 a plurality of hydraulic jacks 110 are disposed to support the ascent and descent of the frame (and the rotary table) as the drill and/or casing string is held, raised or lowered into the associated slips as discussed above.

In the inventive method, the slips are set and the elevators are unlatched. A joint of pipe is picked up by the operators and attached to the existing drill string. Then the entire drill or casing string is lifted with the draw works. The slips are pulled. While the entire string is being lowered and no drill string weight is on the table, electric (or air, or hydraulic) pump 112 moves the jack pistons 114 to their maximum height or extension, thereby raising the frame 110 and the rotary table (not shown).

When the drill string is lowered by the operator via the draw works to the desired position to set the slips, the slips are set. The electric control throttle valve 118 is set to take a certain minimum weight (for example 50 K lbs). A million pound drill string, for example, may activate the throttle valve 118 to open as the frame is urged downwardly by the weight of the drill string (shown by arrows with broken lines) pushing oil from the jack reservoirs JR through the connective piping past the throttle valve 118 through the oil return line 119 and into the main oil reservoir R. Thus, the drill string is "floated" downwardly in its descent. The procedure is repeated with each new pipe joint.

An automatic increase in the throttle valve 118 threshold may be provided as the drill string weight increases as more pipe is connected to the string. Oil flow may be metered by observing and monitoring oil pressure through sensor/recorder 120 and manually or automatically adjusting the throttle valve 118 to compensate for the increased or decreased weight of the string. The closer the pistons 114 get to the bottom of the stroke, the slower the float. This may be set by the throttle valve settings. A high pressure check valve 122 is provided for system safety to allow oil bleed back into the main reservoir as necessary.

As with all embodiments of the present invention, system 200 is provided with a pump 112 and piping that may be used to lift the frame 106 to jack the string out of the borehole by lifting the slips attached to the outer surface of the pipe casing. This is a safe way to push a stuck string upwardly without using forces above the rig floor to pull the string upwardly.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. An apparatus for controlling the ascent and descent of a tubular member passing through a pipe or casing slip into a well bore, said slip disposed on, within, or beneath a rotary table, said apparatus comprising:

a control member releasably attachable to said tubular member beneath the top surface of said slip; and an activation member in communication with said control member to raise or lower said tubular member when said control member is attached to said tubular member.

2. An apparatus for controlling the ascent and descent of a tubular member passing through a pipe or casing slip into a well bore comprising:

a control member releasably attachable to said tubular member beneath the top surface of said slip; and an activation member in communication with said control member to raise or lower said tubular member when said control member is attached to said tubular member, said control member disposed within a slip bowl.

3. An apparatus for controlling the ascent and descent of a tubular member passing through a pipe or casing slip into a well bore comprising:

a control member releasably attachable to said tubular member beneath the top surface of said slip; and an activation member in communication with said control member to raise or lower said tubular member, when said control member is attached to said tubular member, said control member disposed beneath a rotary table.

4. An apparatus for controlling the ascent and descent of a tubular member passing through a pipe or casing slip into a well bore comprising:

a control member releasably attachable to said tubular member beneath the top surface of said slip; and an activation member in communication with said control member to raise or lower said tubular member when said control member is attached to said tubular member, said control member disposed beneath a slip spider, said slip spider disposed at a well head.

5. An apparatus for controlling the ascent and descent of a tubular member passing through a pipe or casing slip into a well bore comprising:

a control member releasably attachable to said tubular member beneath the top surface of said slip; and an activation member in communication with said control member to raise or lower said tubular member when said control member is attached to said tubular member, said control member disposed within a slip wedge.

* * * * *